US010202238B2

(12) United States Patent
Reeb et al.

(10) Patent No.: US 10,202,238 B2
(45) Date of Patent: Feb. 12, 2019

(54) LOCKING DEVICE FOR A CONTAINER

(71) Applicant: SERIO-US INDUSTRIES, INC., Baltimore, MD (US)

(72) Inventors: David L. Reeb, Sykesville, MD (US); James L. Martin, II, Gambrills, MD (US)

(73) Assignee: Serio-Us Industries, Inc., Baltimore, MD (US)

( * ) Notice: Subject to any disclaimer, the term of this patent is extended or adjusted under 35 U.S.C. 154(b) by 477 days.

(21) Appl. No.: 14/963,483

(22) Filed: Dec. 9, 2015

(65) Prior Publication Data

US 2016/0159569 A1 Jun. 9, 2016

Related U.S. Application Data

(60) Provisional application No. 62/089,591, filed on Dec. 9, 2014.

(51) Int. Cl.

| | |
|---|---|
| ***B65F 1/14*** | (2006.01) |
| ***B65F 1/16*** | (2006.01) |
| ***E05B 65/00*** | (2006.01) |
| ***E05B 65/46*** | (2017.01) |
| ***E05C 1/14*** | (2006.01) |
| *E05C 19/10* | (2006.01) |

(52) U.S. Cl.

CPC ..... *B65F 1/1615* (2013.01); *E05B 65/006* (2013.01); *E05B 65/46* (2013.01); *E05C 1/14* (2013.01); *E05C 19/10* (2013.01)

(58) Field of Classification Search

CPC ..... B65F 1/1615; E05B 65/006; E05B 65/46; E05C 1/14; E05C 19/10

See application file for complete search history.

(56) References Cited

U.S. PATENT DOCUMENTS

| | | | | |
|---|---|---|---|---|
| 3,530,696 | A * | 9/1970 | Dunmire | E05B 65/006 404/25 |
| 3,674,298 | A | 7/1972 | Vekony | |
| 5,224,744 | A | 7/1993 | Michelutti | |
| 5,415,314 | A | 5/1995 | McCollum | |
| 5,419,598 | A | 5/1995 | Kreitzer | |
| 5,599,050 | A | 2/1997 | Tinsley | |
| 5,772,061 | A | 6/1998 | Lowe | |

(Continued)

FOREIGN PATENT DOCUMENTS

| | | |
|---|---|---|
| DE | 102007039351 | 11/2008 |
| EP | 2769933 | 8/2014 |

*Primary Examiner* — Anthony Stashick
*Assistant Examiner* — James Way
(74) *Attorney, Agent, or Firm* — Berenato & White, LLC

(57) ABSTRACT

A locking device for a container is provided. The locking device contains a weighted mechanism having a mounting block and at least one paddle mounted on the mounting block. The weighted mechanism is movable between a locked position and an unlocked position. The at least one paddle having two opposing ends. A first end is mounted to the mounting block by a rotatable coupling to allow the paddle to pivot thereon. A second end of the paddle is detachably mounted to a surface of the mounting block, such that a sudden jerking or jarring motion, such as by impact with the ground, causes the second end to detach from the mounting block to block the weighted mechanism from moving from the locked position to the opened position.

20 Claims, 12 Drawing Sheets

(56) References Cited

U.S. PATENT DOCUMENTS

| | | | | |
|---|---|---|---|---|
| 5,772,264 | A | 6/1998 | Bettenhausen | |
| 5,988,711 | A * | 11/1999 | Toma | E05B 47/0047 292/201 |
| 6,666,485 | B1 | 12/2003 | Moret | |
| 6,808,080 | B2 | 10/2004 | Spiers et al. | |
| 6,902,081 | B2 | 6/2005 | Walker | |
| 7,562,918 | B2 * | 7/2009 | Toma | E05B 47/0047 292/340 |
| 7,603,882 | B2 * | 10/2009 | Carbajal | A47F 3/043 292/201 |
| 8,485,382 | B2 | 7/2013 | Raghunathan et al. | |
| 8,810,361 | B2 | 8/2014 | Thukral et al. | |
| 9,346,616 | B2 * | 5/2016 | Foster | B65F 1/122 |
| 9,738,445 | B2 * | 8/2017 | Foster | B65F 1/1615 |
| 9,828,177 | B2 * | 11/2017 | Nussbaum | E05B 15/0093 |
| 2004/0065666 | A1 | 4/2004 | Walker | |
| 2005/0061824 | A1 | 3/2005 | Miller et al. | |
| 2007/0175910 | A1 * | 8/2007 | Hogarth | B65F 1/1615 220/835 |
| 2008/0169289 | A1 | 7/2008 | Dawn | |
| 2010/0102575 | A1 | 4/2010 | Ferkovich et al. | |
| 2012/0273495 | A1 | 11/2012 | D'Alessandro | |
| 2014/0069926 | A1 | 3/2014 | Michael et al. | |
| 2014/0238990 | A1 | 8/2014 | Banik et al. | |
| 2015/0159404 | A1 * | 6/2015 | Treadwell | E05B 65/5292 220/318 |
| 2016/0060898 | A1 * | 3/2016 | Michael | E05B 15/0093 292/200 |

* cited by examiner

LOCKING DEVICE FOR A CONTAINER

CROSS-REFERENCE TO RELATED APPLICATIONS AND CLAIM TO PRIORITY

This application claims the benefit of priority of U.S. Provisional Patent Application No. 62/089,591, filed Dec. 9, 2014, the entire disclosure of which is incorporated herein by reference and to which priority is claimed.

FIELD OF THE INVENTION

The present invention generally relates to locking devices and, more particularly, relates to a locking device for a container, e.g. a waste container.

BACKGROUND OF THE INVENTION

Household refuse such as trash, recycling items, and/or yard waste can typically be deposited in a container. Such containers can include a lid for concealing the household refuse collected therein, as well as to prevent wild animals or people from accessing the household refuse and also protecting the trash from the elements. Typically, the lid is removably coupled to the container in a friction-fit manner to allow the lid to be easily removed from the container. However, when the lid is not secured, the contents can be undesirably expelled from the container, such as if the container is toppled over such as by wind or animals.

Various lid locking devices have been implemented for refuse containers. For example, a strap can be coupled to the lid and the container in a snap lock fashion. However, this locking method requires a plurality of steps to secure the strap, and the strap can easily become separated from the container. Another exemplary locking device includes a metal coil coupled between the lid and the container to provide greater tension. However, the coil can deteriorate due to exposure to the elements.

Therefore a need exists for a locking device that improves upon prior locking devices and solves the problems inherent in known locking devices.

SUMMARY OF THE INVENTION

The present invention provides a locking device, e.g. for a container, that keeps the lid of the container closed when the container is knocked over on its side, with a sudden jerking or jarring motion, such as by impact with the ground, to prevent spillage of its contents. The locking device, however, allows the lid to open when the waste container is tipped over, preferably in a forward direction, by a dumping operation.

According to an aspect of the present invention, the locking device, which may be mounted on the container, contains a weighted mechanism having a mounting block and at least one paddle pivotally mounted on the mounting block. The weighted mechanism is movable between a locked position and an unlocked position. The at least one paddle has two opposing ends. A first end is mounted to the mounting block by a rotatable coupling to allow the paddle to pivot thereon. A second end of the paddle is detachably mounted to a surface of the mounting block, such that a sudden jerking or jarring motion, such as by impact with the ground, causes the second end to detach from the mounting block to block the weighted mechanism from moving from the locked position to the opened position. On the other hand, if the container is tipped over without impact, e.g. by being relatively slowly or easily intentionally laid over by a user, the second end of the paddle remains attached to the mounting surface, which allows the locking block to be moved to an opened position. Essentially, the paddle provides a mechanical sensor that can detect whether the container has been unintendedly tipped over or whether it is being intentionally laid over, such as for dumping.

According to another aspect of the invention, there is provided a locking device for a container. The locking device comprises a knob coupled to a top surface of a lid of the container and a slide trigger configured to slidably engage with a latch coupled to the container. The locking device can further include a weighted mechanism disposed below a bottom surface of the lid of the container. The weighted mechanism can include a mounting block, a slide weight, a plurality of impact detection paddles which serve as a mechanical sensor to detect whether the container has been unintendedly tipped over.

Other aspects of the invention, including apparatus, devices, systems, converters, processes, and the like which constitute part of the invention, will become more apparent upon reading the following detailed description of the exemplary embodiments.

BRIEF DESCRIPTION OF THE DRAWINGS

The accompanying drawings are incorporated in and constitute a part of the specification. The drawings, together with the general description given above and the detailed description of the exemplary embodiments and methods given below, serve to explain the principles of the invention. The objects and advantages of the invention will become apparent from a study of the following specification when viewed in light of the accompanying drawings, in which like elements are given the same or analogous reference numerals and wherein.

DETAILED DESCRIPTION

Figure 1:
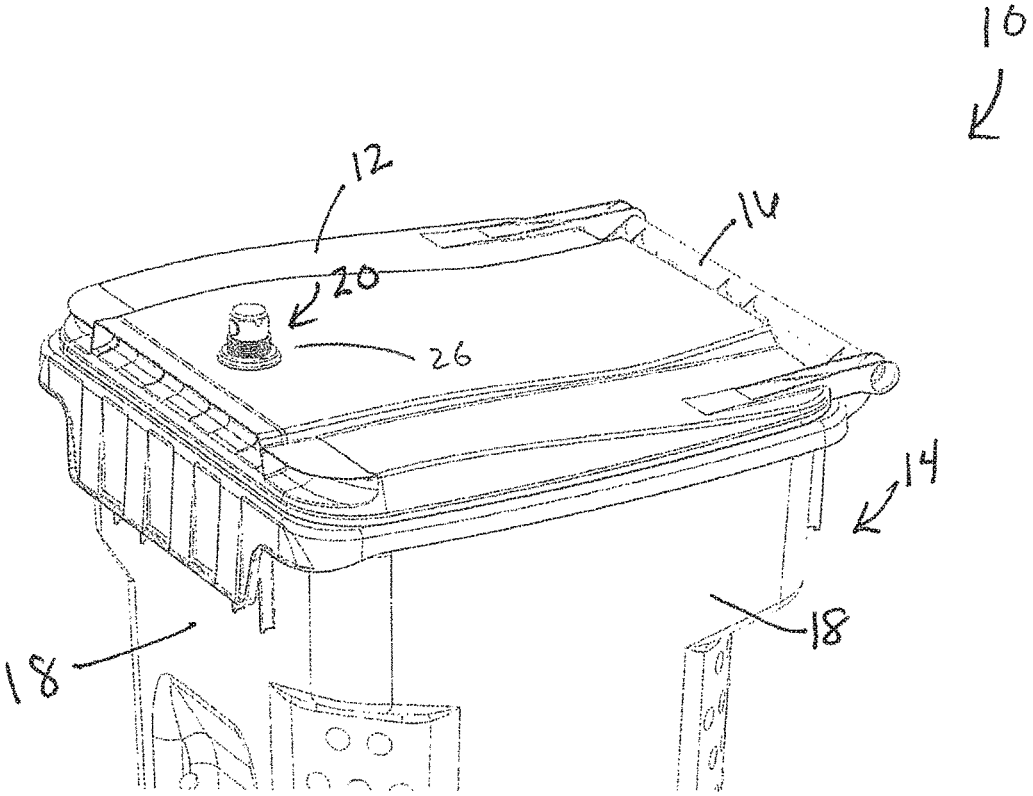
FIG. 1 is a fragmentary perspective view of a container with a locking device according to an exemplary embodiment of the present invention.

Reference will now be made in detail to exemplary embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in connection with the exemplary embodiments and methods.

This description of exemplary embodiments is intended to be read in connection with the accompanying drawings, which are to be considered part of the entire written description. In the description, relative terms such as "horizontal," "vertical," "up," "down," "upper", "lower", "right", "left", "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. Additionally, the word "a" and "an" as used in the claims means "at least one" and the word "two" as used in the claims means "at least two".

Figure 2:
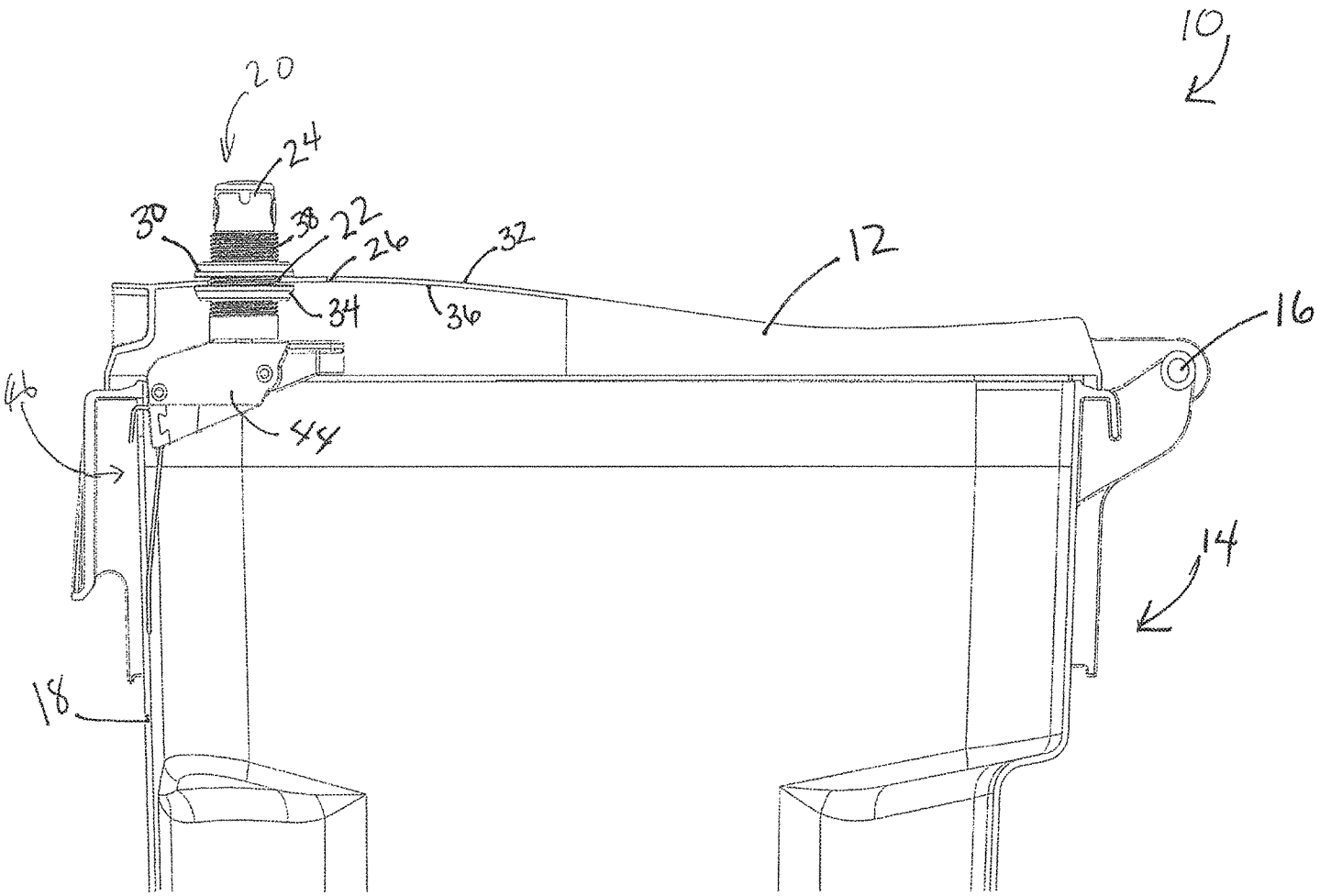
FIG. 2 is a fragmentary partial cross-sectional perspective view of the container of FIG. 1 according to an exemplary embodiment of the present invention.
Figure 3:
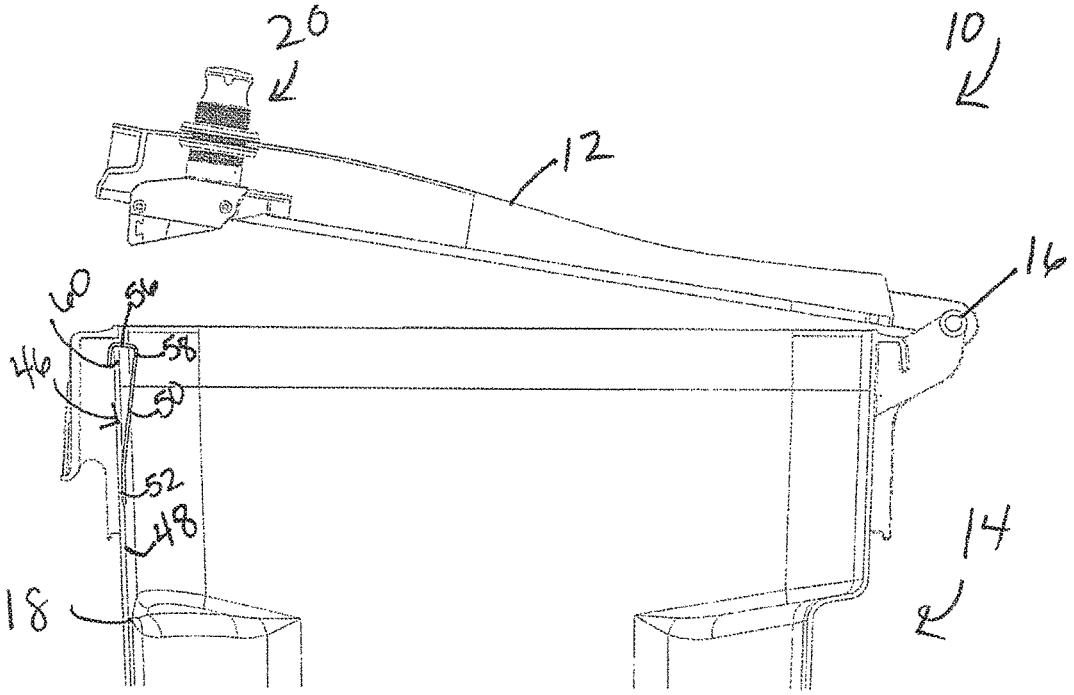
FIG. 3 is another fragmentary partial cross-sectional view of the container of FIG. 1 according to an exemplary embodiment of the present invention.

As best shown in FIGS. 1-3, a container 10 according to an exemplary embodiment of the present invention is illustrated. The container 10 may be a refuse container such as a household refuse container for various items including trash, recycling, and/or yard waste. However, container 10 may be used to accommodate any type of article and may have any shape. For example, container 10 may be annular or polygonal. In addition, container 10 may be made of various materials, such as plastic, metal, or a combination thereof.

Container 10 includes a lid 12 and a containment body 14. The containment body 14 defines an interior volume for holding, e.g., waste. The lid 12 may be separate from the containment body 14 or may be pivotally mounted to the containment body though coupling 16, such as a hinge. The containment body 14 may include a plurality of side walls 18. The lid 12 and the containment body 14 of container 10 may be made of the same or different materials. In an exemplary embodiment, wheels (not shown) may be coupled to the containment body to aid in transport of the container.

Figure 4:
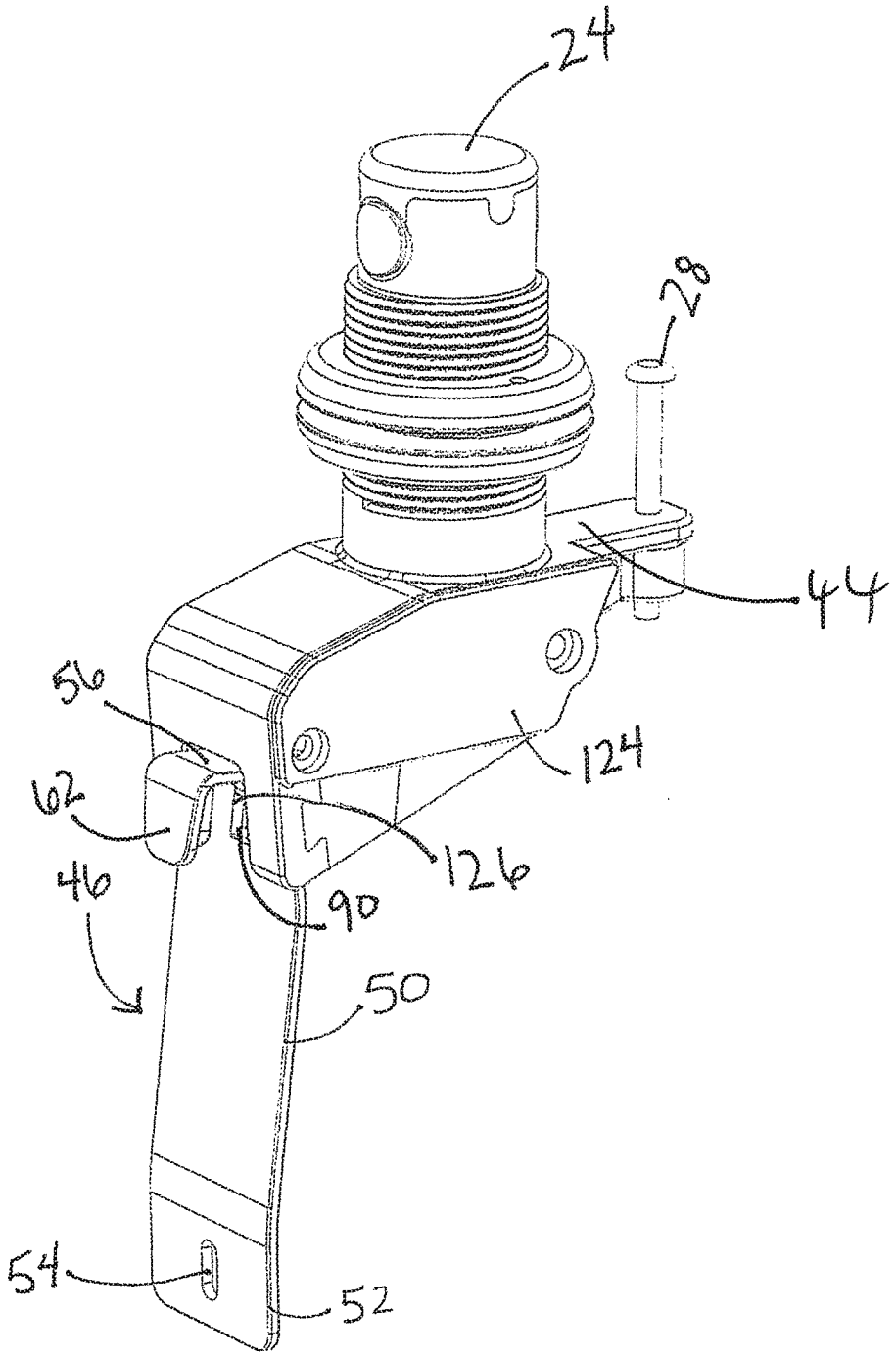
FIG. 4 is a perspective view of a locking device for a container according to an exemplary embodiment of the present invention.

A locking device 20 is coupled to the lid 12 of the container 10. In an exemplary embodiment, as best illustrated in FIG. 2, a first opening 22 may be formed in the lid 12 where a knob 24 of the locking device 20 can extend through the first opening 22 and a second opening 26 can be formed in the lid 12 where a fastener 28 (as illustrated in FIG. 4) can extend through the second opening 26 to secure the locking device 20 to the lid 12. The knob 24 can be secured to the lid 12 using various coupling techniques. In an exemplary embodiment, a first flange 30 may be disposed on a top surface 32 of the lid 12 of the container 10 and a second flange 34 can be disposed on a bottom surface 36 of the lid 12 of the container 10 where the second flange 34 is threaded onto a post 38 coupled to the knob 24. The location of the first flange 30 and/or the second flange 34 may be adjustable based on the thickness of the lid 12. As best illustrated in FIGS. 8-12, the fastener 28 includes a flange portion 40 that when mounted is disposed above the top surface 32 of the lid 12. The flange portion 40 of the fastener 28 has a greater diameter than the second opening 26 formed in the lid 12. The fastener 28 may further include a post 42 coupled to and extending through the housing 44 of the locking device below the bottom surface 36 of the lid 12. Overall, the mounting of the locking device 20 is such that a part of the locking device protrudes above the lid, and thus outside of container 10, as best illustrated in FIGS. 1-3. The locking device 20 is preferably positioned towards the front of the lid 12 for reasons to be apparent below.

The locking device 20 interacts with a latch 46 coupled to the containment body 14 to secure the lid 12 to the containment body 14. As best illustrated in FIGS. 2-3, the latch 46 is coupled to an inner surface 48 of any one of the side walls 18 of the containment body 14, preferably on the side wall opposing the side wall to which the coupling 16 is attached. Latch 46 may be made of various materials such as plastic, metal, high density polypropylene, etc.

As best illustrated in FIGS. 3-4, the latch 46 has an elongated body 50 where a first end 52 of the elongated body 50 is coupled to the inner surface 48 of the side wall 18 through opening 54 using, e.g. a mechanical fastener, such as a bolt, screw, or the like (not shown). In an exemplary embodiment, the elongated body 50 may be angled to extend away from the inner surface 48 of the side wall 18. A protrusion 56 may extend from a second end 58 of the elongated body 50 of the latch 46 where the protrusion 56 extends through an opening 60 in the side wall 18. One end 62 of the protrusion 56 extends below the opening 60 in the side wall such that the elongated body 50 is elastically deformable when the locking device 20 engages the latch 46. The end 62 of the protrusion 56 that extends below the opening 60 in the side wall 18 is positioned to prevent the second end 58 of the elongated body 50 of the latch 46 from separating from the side wall 18 without using a fastener.

When a plurality of containment bodies 14 are nested together (e.g., one inside of another), each latch 46 is mounted so as to not to interfere with an adjacent nested containment body 14. Latch 46 may be coupled to the containment body 14 during the manufacturing process of the containment body 14, after an end user receives the containment body 14, or any time in-between. Alternatively, latch 46 may be integrally formed with a sidewall 18 of the containment body 14.

Figure 5:
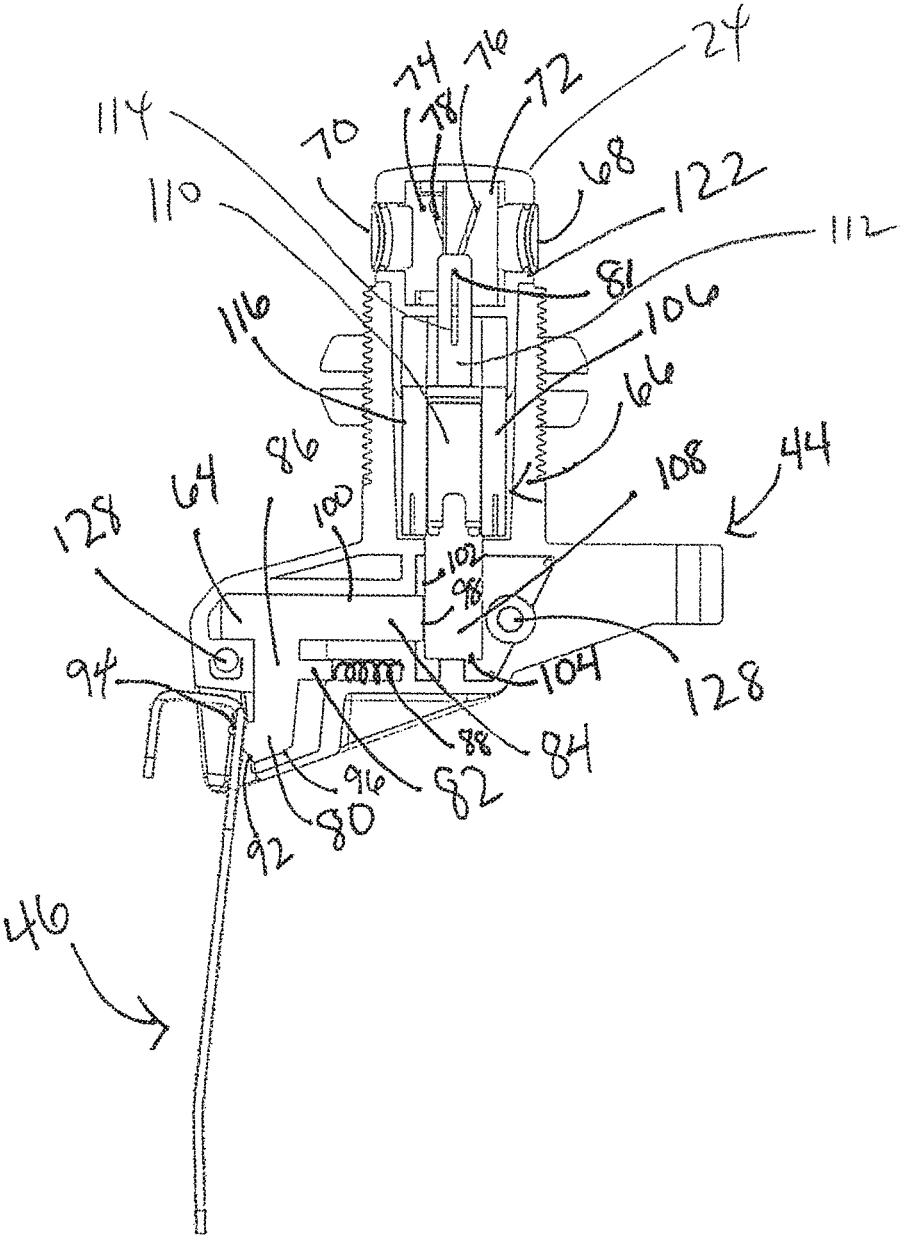
FIG. 5 is a cross-sectional view of the locking device for a container shown in a locked position according to an exemplary embodiment of the present invention.
Figure 6:
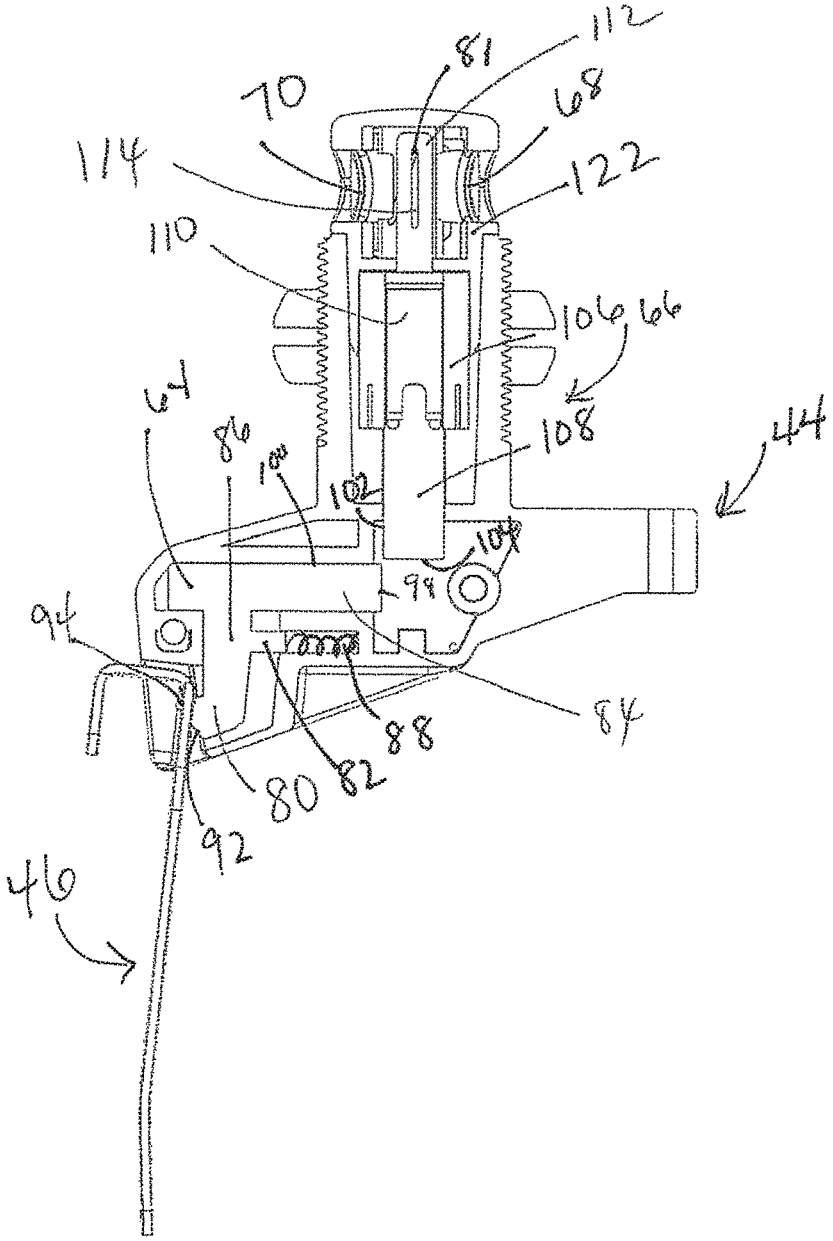
FIG. 6 is a cross-sectional view of the locking device for a container in an intermediary position according to an exemplary embodiment of the present invention.
Figure 11:
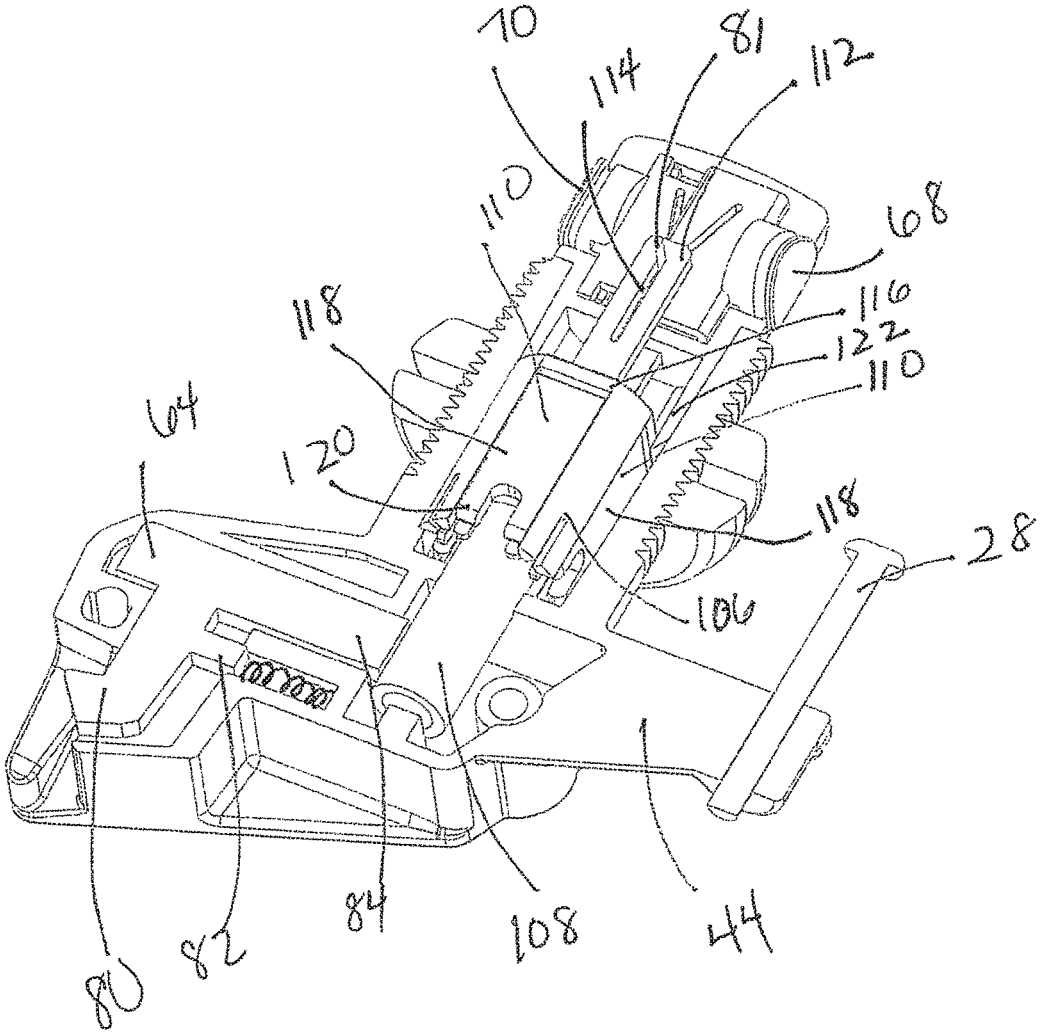
FIG. 11 is a partial cut-away view of the locking device according to an exemplary embodiment of the present invention.
Figure 12:
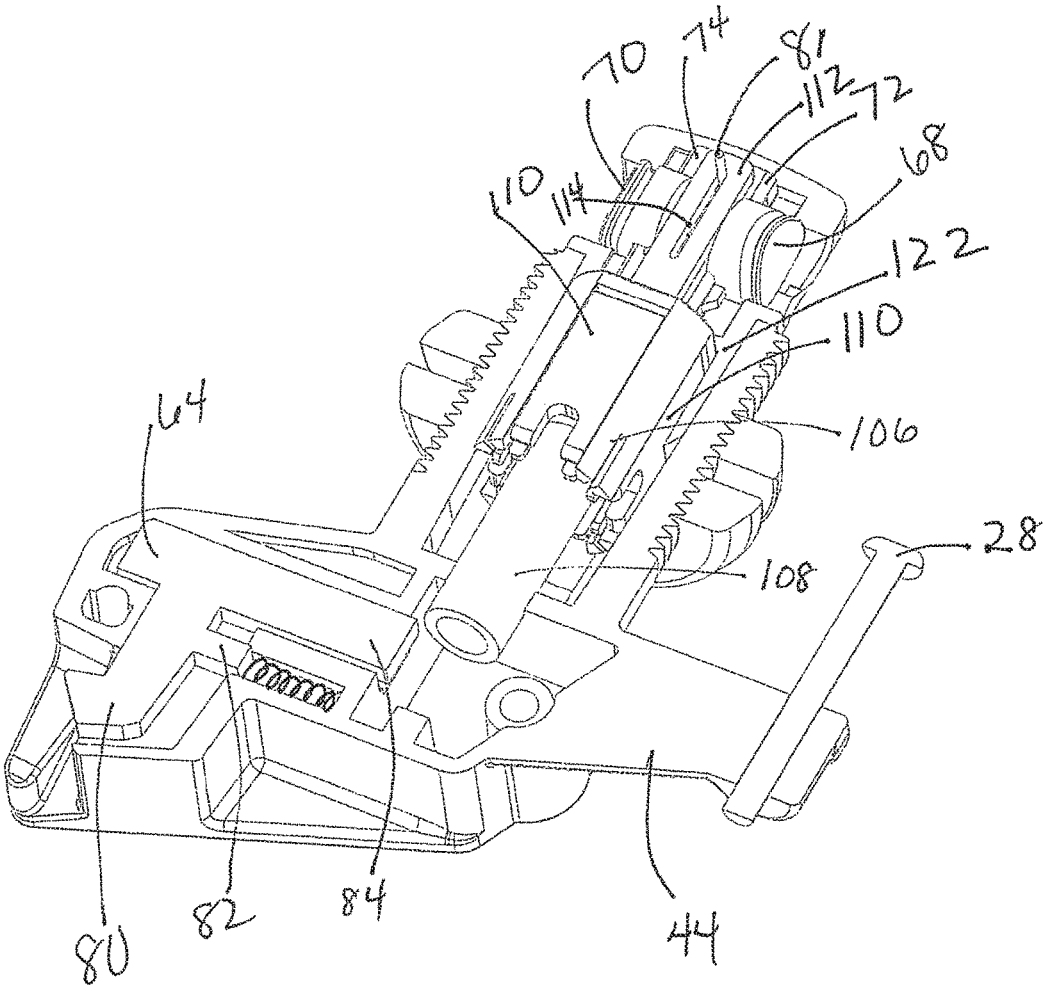
FIG. 12 is a partial cut-away view of the locking device according to an exemplary embodiment of the present invention.

As best illustrated in FIGS. 4-12, the locking device 20 may include the knob 24, a slide trigger 64, a weighted mechanism 66, and the housing 44. The knob 24 includes an actuation device, e.g. at least one pressure sensitive button 68. In an exemplary embodiment, knob 24 includes two pressure sensitive buttons 68, 70 where each of the buttons 68, 70 is coupled to a protrusion 72 or 74, respectively. The first protrusion 72 has a first slit 76; and the second protrusion 74 has a second slit 78 (as best illustrated in FIGS. 5 and 11). The first slit 76, formed in the first protrusion 72 associated with the first button 68, is angled in a first direction; and the second slit 78, formed in the second protrusion 74 associated with the second button 70, is angled in a second direction, such that a first portion of the first slit 76 overlaps a first portion of the second slit 78. When the two pressure sensitive buttons 68, 70 are engaged, the protrusions 72, 74 are displaced and the slits 76, 78 align to allow a pin 81 extending approximately horizontally through both the first slit 76 and the second slit 78 to slide into a second position as illustrated in FIGS. 6 and 12.

The slide trigger 64 is configured to slidably engage with latch 46. In an exemplary embodiment, as best illustrated in FIGS. 5-12, the slide trigger 64 includes at least three projections 80, 82, 84 that extend from a body portion 86. A first projection 80 is associated with the latch 46; a second projection 82 is associated with a biasing device 88, such as a spring; and a third projection 84 is associated with the weighted mechanism 66. While the slide trigger 64 is shown to have a size, shape, and configuration as illustrated in FIGS. 5-12, slide trigger 64 may have any size, shape, and/or configuration that allows the locking device 20 to engage with latch 46 when the locking device 20 is actuated into a locked position.

The first projection 80 of the slide trigger 64 is configured to engage with an opening 90 (see FIG. 4) in the latch 46 when the locking device 20 is in the locked position. Preferably, when the locking device 20 is in the locked position, the first projection 80 forms a hook that mates to the opening 90 in the latch 46. In an exemplary embodiment, as best shown in FIGS. 5-12, the first projection 80 includes a first surface 92 and a second surface 94 arranged at an acute angle to each other, such as about 20-80°, preferably about 25-45°. The first projection 80 may further include a third surface 96 that is approximately similar to the underlying surface configuration of the housing 44. For example, the third surface 96 may be substantially parallel to the underlying surface of the housing 44 such that when the slide trigger 64 is actuated, the third surface 96 does not contact the housing. Overall, the surfaces 92, 94, 96 form a hook for engagement with the opening 90 in the latch 46.

The second projection 82 of the slide trigger 64 is configured to engage with the biasing device 88. In an exemplary embodiment, as best illustrated in FIGS. 5-12, the biasing device 88 may be a coil spring. The biasing device 88 provides a mechanical biasing force to the slide trigger 64, such that when the locking device is in the locked position, the slide trigger 64 is urged into engagement with the latch 46, and when the locking device is in an unlocked position, the slide trigger 64 is urged into disengagement with the latch 46.

The third projection 84 of the slide trigger 64 is configured to engage with the weighted mechanism 66. In an exemplary embodiment, as best shown in FIGS. 5-12, the third projection 84 includes a first surface 98 and a second surface 100. When the locking device 20 is in the locked position, the first surface 98 contacts a side surface 102 of the weighted mechanism 66 and when the locking device is in the unlocked position, the second surface 100 contacts the bottom surface 104 of the weighted mechanism 66.

The weighted mechanism 66 is configured to provide counter balance to the locking mechanism. The weighted mechanism 66 includes a mounting block 106, a slide weight 108 extending from the bottom of the mounting block 106, and one or more impact detection paddles 110 retained on the mounting block 106, as best shown in FIG. 5. Preferably, the paddles 110 are placed equiangularly around the circumference of the mounting block 106. Preferably, two or more paddles 110 are provided, more preferably two to eight, and most preferably four. Paddles 110 preferably resemble rectangular bars. In an exemplary embodiment, the mounting block 106 and the plurality of impact detection paddles 110 may be made of the same material, such as plastic or high density polypropylene, and the slide weight 108 may be made of a metal material, and may resemble a pipe.

Figure 8:
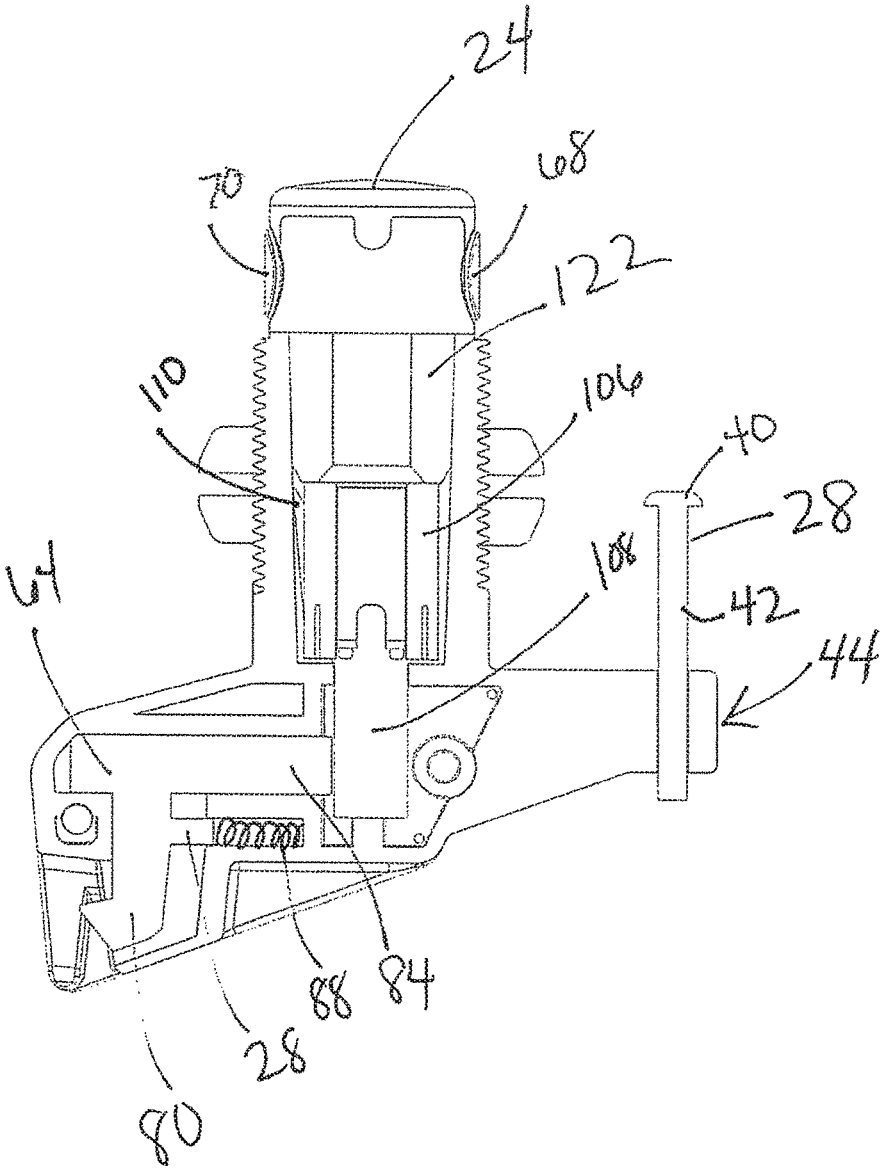
FIG. 8 is a cross-sectional view of the locking device in an impact position according to an exemplary embodiment of the present invention.
Figure 9:
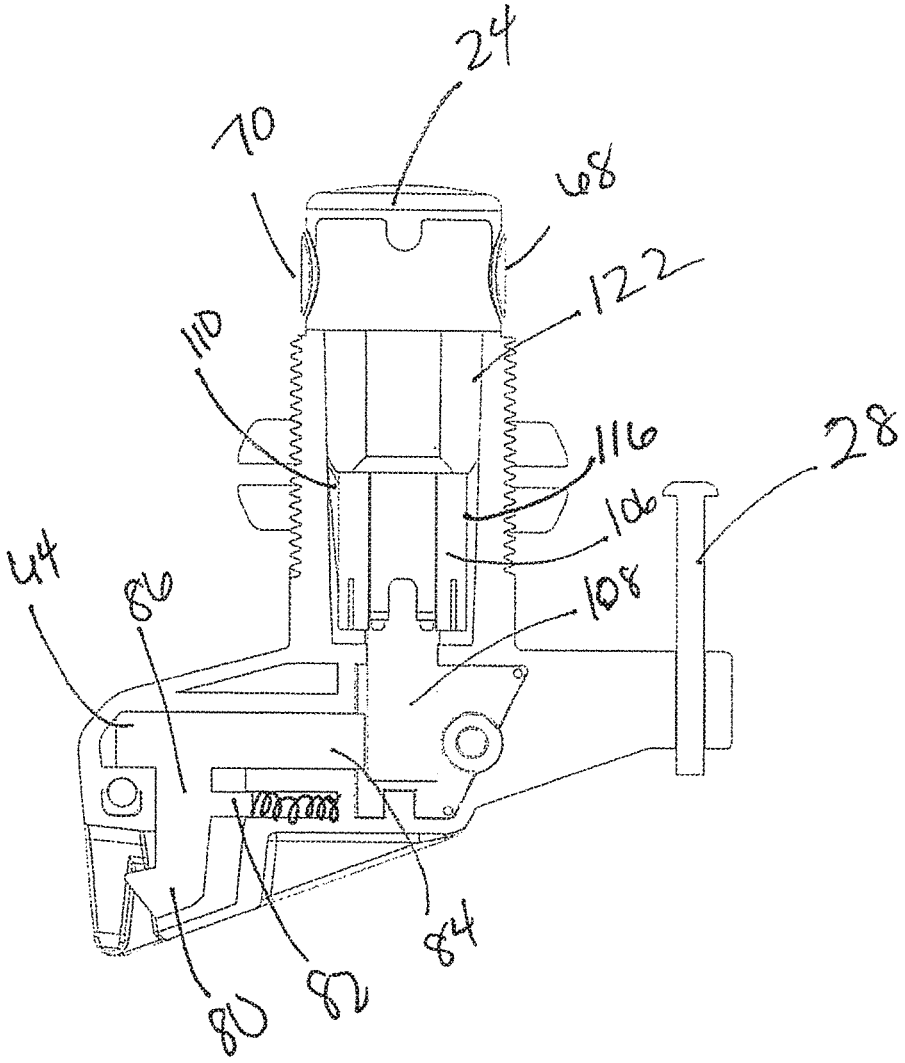
FIG. 9 is a cross-sectional view of the locking device in an another impact position according to an exemplary embodiment of the present invention.
Figure 10:
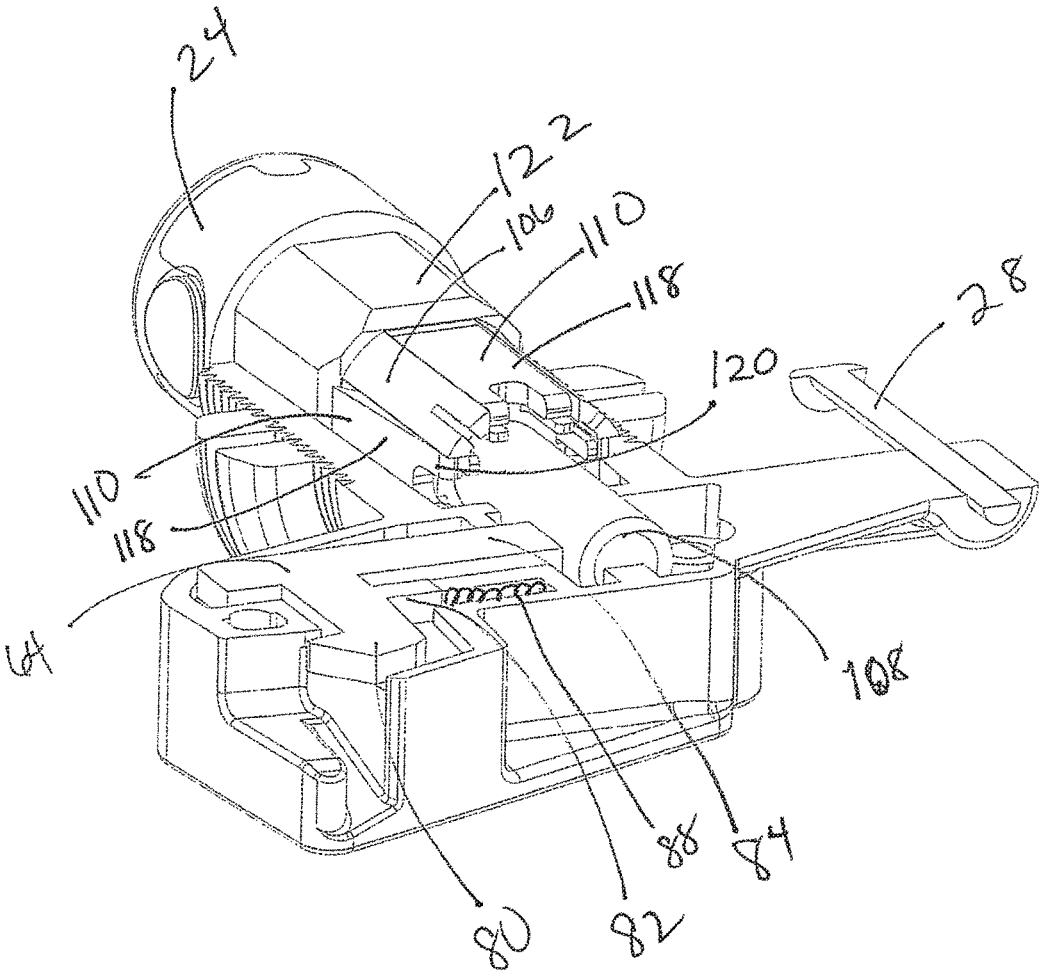
FIG. 10 is a partial cut-away view of the locking device in the impact position according to an exemplary embodiment of the present invention.

As best illustrated in FIG. 11, the mounting block 106 includes a projection 112 having a slot 114 where a pin 81 is disposed in the slot 114 of the projection 112 associated with the mounting block 106 and extends through the first and second slits 76, 78 of the knob 24. The mounting block 106 may have any shape or arrangement. In an exemplary embodiment, as best illustrated in FIGS. 11 and 12, the mounting block 106 may have a shape having four sides where an impact detection paddle 110 is coupled to each side of the mounting block 106. Each impact detection paddle 110 may be mounted to a side of the mounting block 106 where each paddle 110 is recessed from an outer surface 116 of the mounting block 106 such that the outer surface 118 of each paddle 110 is substantially flush with the outer surface 116 of the mounting block 106. Each paddle 110 may be rotatably coupled to the mounting block at a lower portion of the paddle 110 with a rotatable coupling 120, such as a hinge. The upper end of the paddle 110 is preferably detachably retained to the mounting block 106. In an exemplary embodiment, when the upper end of the paddle 110 is attached to the mounting block 106, it is parallel to a center axis of the mounting block, such that when mounted on a container 10, the paddle 110 is approximately parallel to a center line extend between the center of the top and bottom of the container 10. Conversely, when the upper end of the paddle 110 is detached the mounting block 106, the paddle 110 lays at an angle, preferably an acute angle, to the center line. In an exemplary embodiment, the rotatable coupling 120 preferably provides a bias force to prevent the upper end of the paddle 110 from rotating away and detaching from the mounting block unless a force greater than the bias force is introduced. The bias force may be provided at the rotatable coupling 120 by a spring. When a force greater than the bias force is introduced, the paddle 110 rotates about the pivot point at the point of coupling with the mounting block 106 such that an upper portion of the paddle 110 is located outside the plane of the outer surface 116 of the mounting block 106, as best shown in FIGS. 8 and 9. Preferably, the bias force is less than the gravitational force on the paddle 110, when the locking device 20 is on its side, e.g. when the container 10 is knocked over on its side. When a paddle 110 has been actuated to an extended position (rotated away from the mounting block 106), if the mounting block 106 attempts to move in an upward direction, the paddle 110 will abut a barrier structure 122 formed in the locking mechanism housing 44 to prevent the mounting block 106 from triggering disengagement of the locking mechanism 20. In certain embodiments, as shown in the drawings, the paddle 110 may contain a notch at the lower portion of the paddle 110 to provide sufficient flexibility to allow the paddle 110 to be snapped on to the rotatable coupling 120.

In certain embodiments, the bias force to keep the paddle from rotating away and detach from the mounting block 106 may be magnetic. In an exemplary embodiment, a magnet may be place at an upper portion of the paddle 110 opposing the rotatable coupling to magnetically hold the paddle 110 and prevent paddle 110 from rotating away from the mounting block 106. When a force greater than the magnetic force is introduced, the upper portion of the paddle 110 pulls away from the mounting block 106 by pivoting on the rotatable coupling 120. Preferably, the magnetic force is not sufficient to prevent the paddle 110 from rotating away from the mounting block 106 when the locking device 20 is on its side, e.g. when the container 10 is knocked over on its side. A magnet may be permanently placed on the upper end of each paddle 110 and a ferromagnetic material may be used as part of the mounting block 106. Alternatively, the magnet may be placed on the mounting block 106 and a ferromagnetic material placed on the upper end of the paddle 110.

Figure 7:
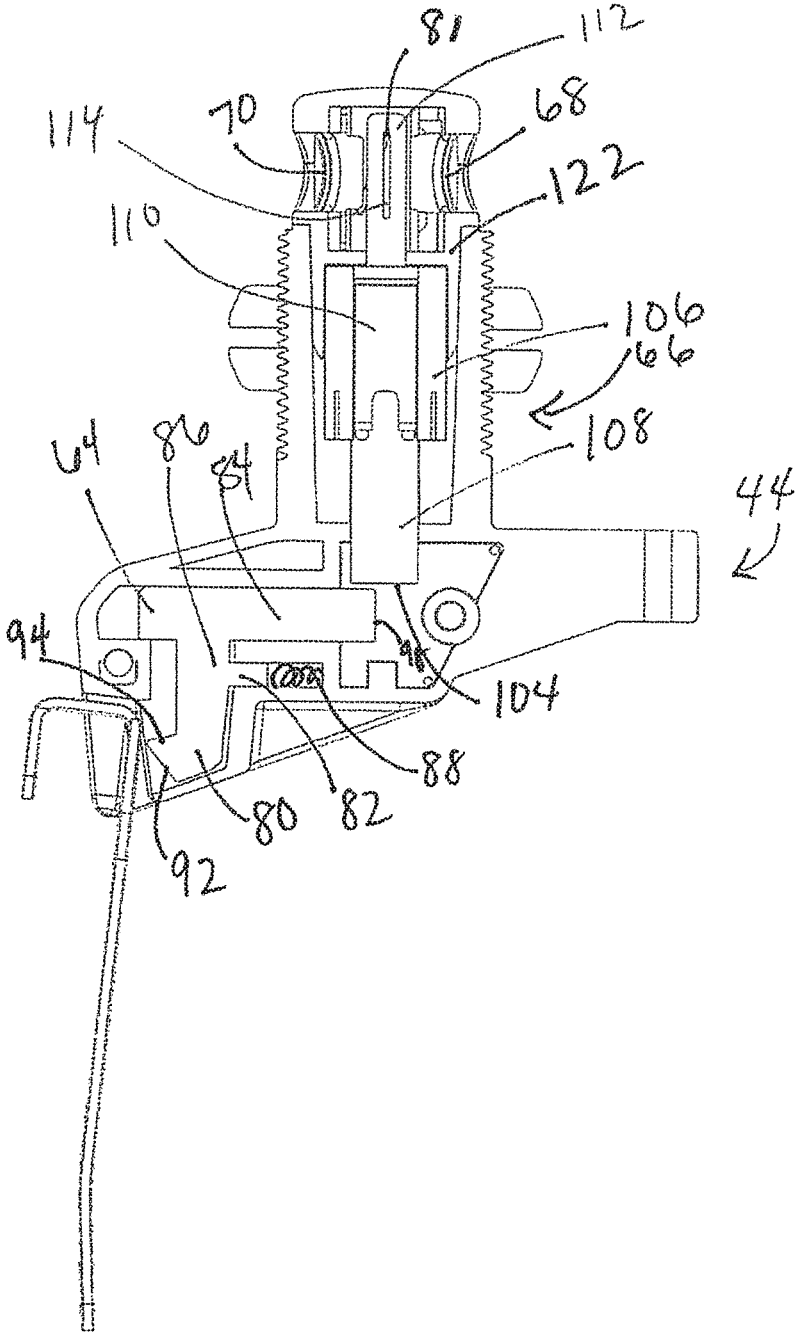
FIG. 7 is a cross-sectional view of the locking device for a container in an unlocked position according to an exemplary embodiment of the present invention.

The weighted mechanism 66 can be actuated using gravity. For example, when the lid 12 is in a closed position and the container 10 is upright, the slide weight 108 extends downwardly from the mounting block 106 as illustrated in FIG. 8 (a locked position of the weighted mechanism). When container 10 is rotated into a dumping position, the weighted mechanism 66 slides upwardly toward the knob as illustrated in FIG. 7 (this is an opened position of the weighted mechanism). In addition, the weighted mechanism 66 may be coupled to the mounting block 106, such that when the two buttons 68, 70 on the knob 24 are pressed and the weighted mechanism 66 moves upwardly toward the knob 24 (opened position) to allow the slide trigger 64 to be disengaged from the latch 46. When the buttons 68, 79 are pressed, the bottom ends of slits 76, 78 come apart and the top ends of slits 76, 78 align. That alignment pulls pin 81 upwardly, thereby moving the weighted mechanism 66 to the opened position. When the weighted mechanism 66 is in the opened position, the slide weight 108 is no longer positioned to block the slide trigger; therefore, when lid 12 is opened the lock 20 moves with the lid. This movement, coupled with the shape and slope of the second surface 94, causes the slide trigger to slide backwardly and compress the biasing device 88.

The housing 44 may be configured to enclose the locking mechanism 20. In an exemplary embodiment, as best illustrated in FIG. 4, the housing 44 may include at least one cover 124 and a latch opening 126 where the protrusion 56 that extends from a second end 58 of the elongated body 50 of the latch 46 is recessed within the latch opening 126 and the sides of the latch opening 126 surround the second end 58 of the elongated body 50 of the latch 46. For example, the latch opening 126 may be a groove formed in the housing 44 such that the second end 58 of the latch 46 engages with the groove formed in the housing 44. As best illustrated in FIGS. 5-12, mounting recesses 128 are formed in the housing 44 wherein a coupling device can engage the mounting recesses 128 to secure the cover 124 to the housing.

In operation, when the locking mechanism 20 is in the locked position, lid 12 of the container 10 is in contact with and encloses the containment body 14. As best illustrated in FIG. 5, the slide trigger 64 is biased to engage with the latch 46, and the slide weight 108 extends downwardly from the mounting block 106 and blocks the slide trigger 64 from sliding away from the latch 46. In addition, each of the plurality of impact detection paddles 110 is within the corresponding recess formed in the mounting block 106. In this locked position, the weighted mechanism 66 hangs downwardly on the pin 81 with the slide weight 108 in position to block the slide trigger 64 from sliding away from the latch 46.

In an exemplary embodiment, when the container 10 is knocked over on its side, e.g. by strong wind or animals, while in the locked position, the jerking or jarring action, such as ground impact, on the container 10, actuates one or more of the impact detection paddles 110 to extend from the outer surface 116 of the mounting block 106 (the paddle 110 pivots away from the mounting block 106), as illustrated in FIGS. 8 and 9. For example, when a force is applied to the container 10, the container 10 may fall to the ground such that one of the side walls 18 impacts the ground with a jerking or jarring motion. A paddle 110 corresponding to the side wall 18 that contacts the ground is engaged after the sidewall 18 impacts the ground, i.e. the paddle 110 is pulled away from its associated recess and pivots away from the mounting block 106. The engaged paddle 110 prevents the lid 12 from opening by preventing the weighted mechanism 66 from sliding toward the knob 24. The abutment of the engaged paddle 110 and the barrier structure 122 (see FIG. 8) prevents the slide weigh 108 from sliding upwardly toward the knob 24 to allow the slide trigger 64 to be disengaged from the latch 46.

On the other hand, when the waste container 10 is laid on its side, e.g. by a user or an automated lifting device on a waste removal vehicle without a jarring or jerking motion, the paddle 110 remains attached to the mounting block 106. That way, the lid 12 may be opened manually by pushing on the pressure sensitive buttons 68, 70, or when the waste container is inverted, gravity allows the lid 12 to open by pulling the weighted mechanism 66 toward the knob 24. The weighted mechanism 66 and its paddles 110, thus, provide a mechanical sensor that can detect whether the container 10 has been unintendedly tipped over or whether it is being tipped over, such as for dumping. Because there is a plurality of paddles 10 disposed on the mounting block 106, the weighed mechanism 66 provides a mechanical sensor that detects unintended tipping of waste container 10 regardless of the direction or distance of tipping. Preferably, four (4) paddles 110 are equiangularly disposed about mounting block 106, such that each paddle 100 may be oriented with one of the side walls 18 where the container 10 is rectangular.

As best illustrated in FIG. 7, when the locking mechanism is 20 in an unlocked position, the slide weight 108 (and the rest of the weighted mechanism 66) slide toward the knob 24 to allow the slide trigger 64 to disengage from the latch 46. As the locking mechanism 20 transitions from the locked position to the unlocked position, as best illustrated in FIG. 6, the two pressure sensitive buttons 68, 70 in the knob 24 are engaged the corresponding protrusions 72, 74 are displaced causing the pin 81 of the weighted mechanism 66 to slide from a first position at the lower portions of the slits 76, 78 to a second position at an upper portions of the slits 76, 78. As the pin 81 slides through the slits 76, 78, the weighted mechanism 66 is pulled toward the knob 24 to allow the slide trigger 64 to disengage from the latch 46 where the slide weight 108 rests on the top surface 100 of the third projection 84.

The above described locking mechanism 20 provides the following advantages. For example, the impact detection paddles 110 prevent the lock from unlocking when the container 10 falls over and impacts the ground in any direction. In addition, due to the biasing forces applied to the impact detection paddles 110, any impact detection paddle 110 that is actuated to extend from the mounting housing 106 during impact will be returned to the unlock position within the recess of the mounting housing 106 when the container 10 is returned to the upright position. Also, removal of the contents of the container 10 may be performed in any direction. For example, due to the auto release properties of the locking mechanism 20, the container 10 may be dumped in any direction when picked up by an automated arm. No additional devices such as keys are needed to actuate the locking mechanism 20, such that the container can be locked and unlocked directly at the container 10 without any additional device. The dual button 68, 70 knob 24 design prevent animals from accessing the container yet allows for easy access by humans because both buttons need to be pressed simultaneously. Latch 46 may be mounted inside of the container body 14 such that when a plurality of containers are nested, each latch 46 is pressed flat against an associated side wall. Moreover, the locking mechanism 20 is mounted to the lid 12 of the container 10 thereby separating the locking mechanism 20 from the waste stream to prevent undesired deterioration.

The foregoing description of the preferred embodiments of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes may be made in the above-described invention without departing from the intent and scope thereof. It is also intended that the scope of the present invention be defined by the claims appended thereto.

What is claimed is:

1. A locking device comprising a weighted mechanism movable between a locked position and an opened position, the opened position allows the lock to be unlocked and the locked position keeps the lock locked, wherein the weighted mechanism contains A. a mounting block;

B. a slide weight extending from the bottom of the mounting block; and

C. one or more paddles, each paddle having an opposing first end and second end, the first end is mounted to the mounting block by a rotatable coupling, and the second end locating farther away from the slide weight than the first end and is detachably retained on a surface of the mounting block by a bias force provided by magnetic attraction or a spring at the rotatable coupling, so that when the second end is detached from the surface, it is positionable to block the weighted mechanism from moving to the unlocked position.

2. The locking device of claim 1, further comprising a slide trigger that is engaged with a latch when the weighted mechanism is in the locked position, and is released from the latch when the weighted mechanism is in opened position.

3. The locking device of claim 1, wherein the paddle is mounted in a recess on a side of the mounting block.

4. The locking device of claim 1, wherein two to eight paddles are disposed equiangularly around a perimeter of the mounting block.

5. The locking device of claim 2, wherein when the weighted device is in the locked position, the slide weight blocks the slide trigger from releasing from the latch.

6. The locking device of claim 5, further comprising a knob above the weighted container, the knob contains an actuation device for manually placing the weighted mechanism in the opened position.

7. The locking device of claim 6, wherein the mounting block further contains a projection having a slot therein, the slot is coupled to the actuation device via a pin.

8. A waste container comprising a containment body, a lid attached to the main box by a hinge, the lid comprising the locking device of claim 1 mounted therein.

9. The waste container of claim 8, wherein the locking device keeps the lid closed when the waste container falls over and impacts the ground in any direction.

10. The waste container of claim 8, wherein the locking device is mounted in a cutout in the lid.

11. The waste container of claim 8, further comprising a slide trigger that is engaged with a latch when the weighted mechanism is in the locked position, and is released from the latch when the weighted mechanism is in the opened position.

12. The waste container of claim 8, wherein the paddle is mounted in a recess on a side of the mounting block.

13. The waste container of claim 12, wherein when the weighted device is in the locked position, the slide weight blocks the slide trigger from releasing from the latch.

14. The waste container of claim 13, further comprising a knob above the weighted container, the knob contains an actuation device for manually placing the weighted mechanism in the opened position.

15. The waste container of claim 14, wherein the mounting block further contains a projection having a slot thereon, the slot is coupled to the actuation device via a pin.

16. A method for making a waste container, comprising the steps of:

a. providing the waste container containing a containment body, a lid attached to the main box by a hinge; and b. mounting the locking device of claim 1 in a cutout of the lid.

17. The locking device of claim 1, wherein when the second end of the paddle is attached to the mounting block, the paddle is parallel to a center axis of the mounting block.

18. The locking device of claim 1, wherein when the second end of the paddle is detached from the mounting block, the paddle lays at an acute angle to a center axis of the mounting block.

19. The locking device of claim 1, further comprising a housing enclosing the weighted mechanism.

20. The locking device of claim 1, the magnetic attraction is provided by i) a magnet placed on the second end of each paddle; or ii) a magnet placed on the mounting block.

* * * * *